United States Patent [19]

Nieminen

[11] Patent Number: 4,799,937

[45] Date of Patent: Jan. 24, 1989

[54] METHOD AND APPARATUS FOR GASIFYING CARBONACEOUS MATERIAL

[75] Inventor: Jorma J. Nieminen, Varkaus, Finland

[73] Assignee: A. Ahlstrom Corp., Varkaus, Finland

[21] Appl. No.: 102,142

[22] PCT Filed: Jan. 21, 1987

[86] PCT No.: PCT/FI87/00011

§ 371 Date: Sep. 22, 1987

§ 102(e) Date: Sep. 22, 1987

[87] PCT Pub. No.: WO87/04453

PCT Pub. Date: Jul. 30, 1987

[51] Int. Cl.[4] ..... C10J 3/54; C10J 3/56

[52] U.S. Cl. ..... 48/62 R; 48/63; 48/202; 48/206; 422/142

[58] Field of Search ..... 48/62 R, 63, 76, 77, 48/197 R, 202, 203, 206, 210; 201/12, 28, 31, 2.5; 422/142, 147; 432/15, 58; 34/10, 57 R, 57 A; 423/DIG. 16

[56] References Cited

U.S. PATENT DOCUMENTS

| | | | |
|---|---|---|---|
| 1,913,968 | 6/1933 | Winkler | 48/203 |
| 2,786,280 | 3/1957 | Gishler et al. | 34/10 |
| 4,146,369 | 3/1979 | Flesch et al. | 48/202 |
| 4,200,438 | 4/1980 | Kaimann et al. | 48/206 |
| 4,704,138 | 11/1987 | Smith | 48/210 |

FOREIGN PATENT DOCUMENTS

| | | | |
|---|---|---|---|
| 2312283 | 10/1973 | Fed. Rep. of Germany . | |
| 42233 | 9/1983 | Japan | 48/210 |
| 2065162 | 6/1981 | United Kingdom . | |
| 2086411 | 5/1982 | United Kingdom . | |

*Primary Examiner*—David L. Lacey
*Assistant Examiner*—Joye L. Woodard
*Attorney, Agent, or Firm*—Nixon & Vanderhyde

[57] ABSTRACT

A method of and apparatus for gasifying carbonaceous material in a circulating fluidized bed reactor having a lower reactor chamber and an upper reactor chamber interconnected by a throttled throat portion. Carbonaceous material is supplied to a first fluidized bed gasification zone maintained in the lower chamber and is gasified there by a gasifying agent and recycled hot particles separated from the product gas. The effluent from the first gasification zone is passed upwardly through the throttled throat portion to a second fluidized bed gasification zone of the spouting-bed type maintained in the upper chamber to complete gasification of unconverted carbon remaining in the particles entrained in the gaseous effluent from the first zone at a higher temperature than that of the first zone.

13 Claims, 1 Drawing Sheet

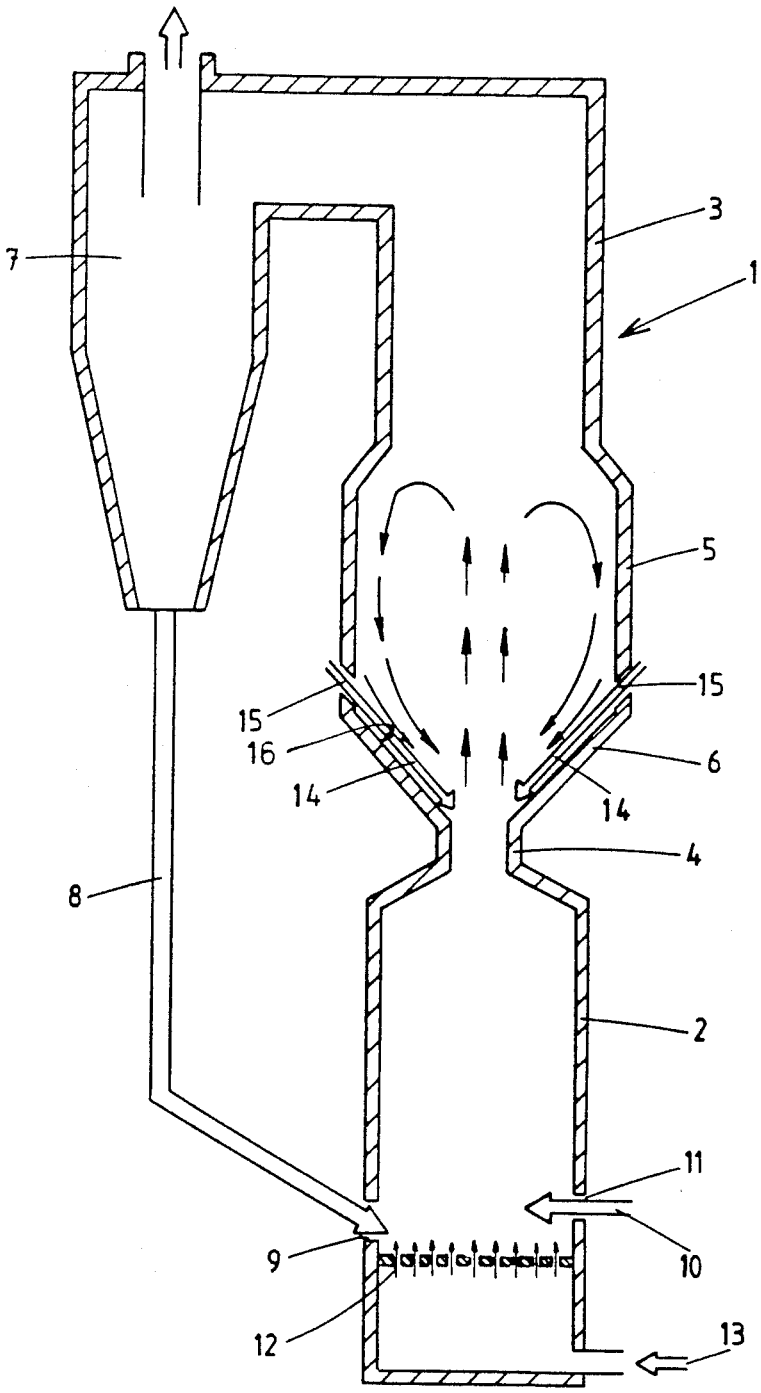
3
1
7
5
15
15
16
6
14
14
4
8
2
11
9
10
12
13

METHOD AND APPARATUS FOR GASIFYING CARBONACEOUS MATERIAL

BACKGROUND OF THE INVENTION

1. Technical Field

The present invention relates to a method for gasification of carbonaceous material in two phases in a circulating fludized bed reactor in which solid particles contained in gases exhausted from the reactor are separated and recycled to the reactor. The invention also relates to an apparatus for carrying out the method.

It is an object of the invention to provide a method and an apparatus for producing gas of low tar content by utilizing fluidized bed technology for gasification of a carbonaceous material such as coal, brown coal or peat.

2. Prior Art

Two-staged gasification is known technology. The so called HTW gasifier (Hochtemperatur-Winkler) could be mentioned as an example. In an apparatus of this kind the gasifying agent of the second phase is, however, supplied "unselected" directly to the gasified mixture which, in addition to coal and tarry substances, contains gases (hydrogen, carbon monoxide, methane) which are the desired end products of the gasification process. Oxygen then reacts primarily with these gaseous substances although a reaction with the coal would be advantagous for the product of the gasification. Contact of the coal and the supplied aqueous steam also decreases which results in an incomplete coal conversion and low grade gas.

British patent specification No. 1506729 discloses a method of gasifying carbonaceous material in a circulating fluidized bed reactor which is devided into two parts and in which the carbonaceous material is supplied to the upper part of a gasification reactor. When the first stage of the gasification, for example pyrolyses of the volatiles, during which pyrolysis for example tarry substances build up, takes place in the upper part of the reactor, the tarry substances remain in the product gas. The amount of these tarry substances depends on the gasified material and the gasification temperature and it may, e.g. in case of coal, be small. The object of this prior method does not primarily seem to be to produce gas of low tar content either but to achieve an as good a coal conversion as possible. The primary object of the present invention, on the other hand, is to produce gas containing as little tar as possible. Thus the upper part of the reactor is used for removing tar by raising the temperature. An essential feature is that the temperature is increased by combusting coal and not gaseous components. To achieve this, a spouting type fluidized bed is used.

Finnish patent specification No. 62554 discloses a two-staged gasification method, in which the beginning of the gasification process is carried out in the upper part of the reactor, as in the method of GB No. 1506729 mentioned above, and the tarry substances remain inn the product gas.

DISCLOSURE OF INVENTION

The present invention is characterized in that carbonaceous material is supplied to a first zone in a lower chamber of a gasifying reactor and is there gasified by a gasifying agent and hot particles separated from the gas, and that the remaining non-gasified material carried by the gas from the first zone is arranged to contact the gasifying agent by supplying the remaining non-gasified material to the solids running down in the spouting type fluidized bed of a second zone in an upper chamber of the fluidized bed reactor, the temperature of which is maintained higher than the temperature of the first zone. A "spouting type" reactor typically has an upward flow in the center and a downward flow of solid material at the periphery.

An apparatus for carrying out the method of the present invention is characterized in that the inlet of the particles to be recycled to the reactor and the inlet of the carbonaceous material are located in the lower reactor; that the upper reactor comprises an upward widening portion; and that the inlet/inlets of the gasifying agent of the upper reactor is/are located close to the surface formed by the upward widening portion.

In the method of the present invention the lower reactor is primarily used as a pyrolysis reactor for gasification of volatile particles. Gasification of the remaining coal and tar removal are carried out in a spouting type lower portion of the upper reactor in which lower portion the gas, which contains oxygen and is required for a raise of temperature and the gasification process, and aqueous steam are arranged to contact primarily coal by supplying them to the coal and other circulating material running down in the conical part of the zone.

BRIEF DESCRIPTION OF THE DRAWING

The invention is described further, by way of example, with reference to the attached drawing which is a schematic illustration of a fluidized bed reactor.

BEST MODE OF CARRYING OUT THE INVENTION

The method of the present invention is based on the use of a reactor (1) of the type wherein solids circulate. The reactor is divided in two regions or zones which are herein referred to as a lower reactor chamber 2 and an upper reactor chamber 3. Between the reactor zones in chambers 2, 3 there is a throttle 4 in which the flow velocity of the gas increases thus preventing the circulating material from running from the upper reactor chamber 3 to the lower reactor chamber 2. A bottom portion 5 of the upper reactor chamber is designed to create a fluidized bed of so called spouting type. This is realized by the widening of the cross section area of the reactor which decreases the velocity of the vertical flow. A bottom portion 6 of the widened portion is conical with an inclination of between 20° and 60° relative the horizontal.

The cross sectional area in the upper portion of the upper reactor chamber 3 is reduced to be equal to the cross sectional area of the lower reactor chamber 2. The circulating materials carried by the gas (ash, residual coal, etc.) are separated from the gas in a cyclone separator 7 arranged downstream in the process after the upper reactor chamber 3. From the separator 7 the separated material is returned through a return duct 8 and an inlet 9 down to the lower reactor chamber.

Carbonaceous material 10 to be gasified is supplied through an inlet 11 to the lower reactor chamber 2 in which it is gasified at a low temperature, preferably 700° to 900° C., by means of the hot particles separated from the gas and by means of gasifying agent 13 supplied to the lower reactor chamber through orifices 12 in a bottom plate. Oxygen-containing gas, such as air, and possibly steam is used as the gasifying agent. The temperature of the gas is chosen so as to produce a low coal conversion in the gasification and gas of rather a high tar content. The amount of coal in the lower reactor chamber is regulated by supplying, if required, steam with the oxygen-containing gas and by changing the gasifying temperature. The primary function of the lower reactor chamber is to serve as a pyrolysis reactor for the gasifying substances contained in the carbonaceous material supplied to the reactor. Further, partial oxidation of the fuel to be gasified can also be carried out in the lower reactor chamber.

A gaseous effluent mixture of fuel containing coal and tarry substances flows from the lower reactor chamber through the throttle 4 to the upper reactor chamber. The purpose of using a spouting type fluidized bed is to raise the reaction temperature to 900° to 1100° C. by adding oxygen-containing gas and steam so as to cause the oxygen-containing gas and steam to react primarily with the coal and not with the gas. Thus a zone is created in the upper reactor chamber in which zone the coal concentration of the gas is remarkably higher than the average. This kind of a fluidized bed typically has an upward flow in the center and a downward flow of solid material at the periphery thereof. A layer of downwardly running solids builds up in the conical portion 6 at the bottom of the upper reactor chamber. This layer is rich in coal. Oxygen-containing gas and steam 14 are supplied through inlets 15 to this layer of solid material running down along surface 16, whereby the gas and the steam react with the coal contained in the layer and thus raise the temperature as desired. The supply of steam causes an endothermic reaction which reduces the temperature and this must be compensated for by supplying the oxygen-containing gas. The use of steam, on the other hand, improves the gasification of coal. Removal of tar is based on the rise in temperature, i.e. thermal disintegration.

The following conditions are appropriate for the operation of the method and apparatus according to the invention.

Flow velocity range of the gasifier:
lower reactor 3 to 10 m/s
throttle between the lower and the upper reactor 10 to 15 m/s
spouting portion of the upper reactor 1 to 4 m/s
upper portion of the upper reactor 4 to 12 m/s
Pressure in the gasifier (absolute) 1 to 6 bar The invention is not to be limited to the embodiments described here but it can be modified and applied within the scope of protection defined by the appended claims.

I claim:

1. A method of gasifying carbonaceous material in a circulating fluidized bed reactor having a lower chamber and an upper chamber interconnected by a throttled throat portion, the method comprising:

(a) supplying a solid carbonaceous material to a first fluided bed zone maintained in the lower chamber of the fluidized bed reactor;

(b) gasifying said carbonaceous material at a first temperature in said first zone by introducing a first gasifying agent and hot heat transfer particles into the lower chamber and producing a first zone gaseous effluent containing entrained particles;

(c) supplying said first zone effluent to a second fluidized bed zone of the spouting-type maintained in the upper chamber by passing the first zone effluent upwardly through the interconnecting throttled throat portion;

(d) gasifying unconverted carbon remaining in the entrained particles of the first zone effluent in the second zone at a second temperature which is higher than said first temperature by introducing a second gasifying agent and producing a product gas containing entrained hot particles;

(e) withdrawing said product gas from the upper chamber and separating the entrained hot particles from the product gas; and (f) recycling the separated hot particles to the lower chamber for supplying the first zone with hot heat transfer particles.

2. A method as defined in claim 1 wherein said upper chamber includes a downwardly and inwardly extending conical bottom wall portion which receives a downward flow of solids of the spouting-type fluidized bed, and wherein said second gasifying agent is introduced downwardly along said conical bottom wall portion.

3. A method as claimed in claim 1, wherein said first temperature in the first zone is from 700° to 900° C.

4. A method as claimed in claim 1, wherein said second temperature in the second zone is from 900° to 1100° C.

5. A method as claimed in claim 1, wherein the gasifying agents comprise oxygen-containing gas and aqueous steam.

6. A method as claimed in claim 1, wherein the first zone gaseous effluent passing upwardly through the throttled throat portion has a velocity maintained high enough to prevent particles from running from the second zone to the first zone.

7. A method as claimed in claim 6, wherein the velocity of the gas in the first zone is from 3 to 10 m/s.

8. A method as claimed in claim 7, wherein the velocity of gas in the central spouting portion of the spouting-type fluidized bed in the second zone is 1 to 4 m/s.

9. A method as claimed in claim 8, wherein the velocity of the first zone gaseous effluent passing upwardly through the throttled throat portion is from 10 to 15 m/s.

10. A circulating fluidized bed reactor for gasifying carbonaceous material comprising:

a lower reactor chamber;

an upper reactor chamber including an upwardly and outwardly diverging bottom wall portion defining a spouting-type fluidized bed zone;

a throttled throat portion interconnecting the lower reactor chamber and the upper reactor chamber;

means for supplying a first gasifying agent and a carbonaceous material to said lower reactor chamber;

means for supplying a second gasifying agent to said upper reactor chamber in a downward direction along said diverging bottom wall portion;

means for exhausting product gases containing entrained particles from the upper reactor chamber; and means for separating the particles entrained in the product gases exhausted from the upper reactor chamber and for recycling the separated particles to said lower reactor chamber.

11. A fluidized bed reactor as claimed in claim 10, wherein said diverging bottom wall portion of said upper reactor chamber is conical.

12. A fluidized bed reactor as claimed in claim 11, said diverging bottom wall portion has an inclination in relation to a horizontal level of between 20° and 60° C.

13. A fluidized bed reactor as claimed in claim 10, wherein the upper reactor chamber includes an upper portion above the diverging bottom wall portion which has a cross-sectional area that is larger than a cross sectional area of the lower reactor chamber.

* * * * *